United States Patent [19]

Nycz

[11] Patent Number: 4,801,054

[45] Date of Patent: Jan. 31, 1989

[54] WATERTIGHT MOLDED PLASTIC DISPENSING CLOSURE

[75] Inventor: Joseph D. Nycz, Haskins, Ohio

[73] Assignee: Owens-Illinois Closure Inc., Toledo, Ohio

[21] Appl. No.: 70,262

[22] Filed: Jul. 6, 1987

[51] Int. Cl.[4] ..... B65D 43/14

[52] U.S. Cl. ..... 222/545; 215/235; 222/556

[58] Field of Search ..... 222/153, 517, 545–546, 222/556; 215/235, 236, 237; 220/291, 334, 337, 339

[56] References Cited

U.S. PATENT DOCUMENTS

| | | | |
|---|---|---|---|
| 3,220,619 | 11/1965 | Lodding et al. | 222/545 X |
| 3,319,842 | 5/1967 | Miller | 222/484 X |
| 4,420,089 | 12/1983 | Walker et al. | 215/216 |
| 4,545,495 | 10/1985 | Kinsley | 215/235 |
| 4,591,078 | 5/1986 | Weissman | 222/517 |
| 4,635,823 | 1/1987 | Stull | 222/108 |
| 4,638,916 | 1/1987 | Beck et al. | 215/235 |

*Primary Examiner*—Michael S. Huppert

[57] ABSTRACT

A molded plastic dispensing closure for attachment to the finish of a container. The closure has a body portion which is directly attached to the finish and a cover portion which is hingedly attached to the body portion and which is foldable with respect to the body portion. The body portion has a dispensing opening therein which is surrounded by an outwardly extending dispensing spout, and the dispensing spout is surrounded by a generally flat annular surface. The cover portion is foldable with respect to the body portion between a first position, in which the dispensing spout is sealed by inner and outer annular sealing fins that are carried by the cover portion, and a second position in which the container is open for dispensing through the body portion. One of the body and cover portions of the closure is provided with a secondary sealing fin which seals against the other portion in an annular pattern that surrounds the generally flat annular surface when the cover portion is in the first position.

16 Claims, 3 Drawing Sheets

WATERTIGHT MOLDED PLASTIC DISPENSING CLOSURE

BACKGROUND OF THE INVENTION

1. Field of the Invention

This invention relates to a molded plastic dispensing closure for a bottle or other container, that is, to a molded plastic closure which permits the removal of the contents of the container through the closure without removing the closure from the container. More particularly, this invention relates to a unitary molded plastic dispensing closure for a bottle or other container that includes a first portion with a dispensing opening which is secured to the container and a second portion which is hingedly connected to the first portion and which is movable with respect to the first portion to selectively open or close the dispensing opening in the first portion.

2. Description of the Prior Art

U.S. Pat. Nos. 4,545,495 (Kinsley) and 4,638,916 (Beck et al.) each describes a molded plastic dispensing closures for a container in which a dispensing opening in a first portion of the closure that is affixed to the container at an opening therein is selectively opened or closed by a second portion of the closure that is hingedly connected to the first portion. Closures of this general type have been successfully utilized in the packaging of cosmetic and other non-comestible products. However, in the packaging of certain comestible products such as chocolate syrup and condiments such as mustard and catsup, the product is packaged at an elevated temperature and the package is forceably cooled by spraying it with water. The cooling within the closure which results from the water spray cooling of the package creates a partial vacuum within the closure which tends to draw in water from the cooling spray. This usually does not create a problem within the container itself, since the dispensing opening in the first portion of the closure is normally sealed by the second or hinged portion of the closure. However, the dispensing opening in the first portion of the closure is usually smaller than the opening in the associated container, thus, leaving an annular space within the closure and around the dispensing opening which is usually flat and which, if not sealed, will accumulate cooling water therein. This water will stagnate in time, especially on a flat surface, and this can lead to the growth of bacteria, mold or fungi within the closure which, of course, is quite objectionable. Further, if the stagnate accumulated water within the closure in the annulus surrounding the dispensing opening does evaporate, and unsightly residue will remain.

U.S. Pat. No. 4,420,089 (Walker et al.) does disclose the use of a pair of sealing elements in a hinged closure, but both of these sealing elements are primary sealing elements, that is, they are sealing elements which seal the container itself against loss of its contents and against the ingress of contaminants into the container and, in any case, this reference does not relate to a dispensing closure in which there is a dispensing opening that is surrounded by a generally flat, annular portion on which moisture can accumulate, and it does not teach that the closure disclosed therein is suited for the packaging of a product at elevated temperature followed by a spray cooling of the package. U.S. Pat. No. 4,424,910 (Heinol) also discloses a seal between the first and second hinged members of a plastic closure, but, again, this reference does not relate to a dispensing closure in which there is a dispensing opening that is surrounded by a generally flat, annular portion on which moisture can accumulate, and it does not teach that the closure described therein is suited for the packaging of a product at elevated temperatures followed by spray cooling of the package.

SUMMARY OF THE INVENTION

According to the present invention there is provided a molded plastic dispensing closure that includes a first portion which is affixed to the finish of a container and which has a dispensing spout through which the contents of the container can be dispensed and a generally flat annular portion surrounding the dispensing spout, and a second portion which is hingedly attached to the first portion and which is movable between a first position which opens the dispensing spout of the first portion to dispensing and a second position in which the second portion sealingly engages the dispensing spout of the first position to close the container. Further, either the first portion or the second portion is provided with an annular sealing fin surrounding the dispensing spout in the first portion. This sealing fin engages the other portion when the second portion is folded into a closing position with respect to the first portion to seal the annulus between the sealing fin and the dispensing spout against the ingress of moisture during the spray cooling of the container. Preferably, the sealing fin is located at or near the periphery of the member to which it is attached to maximize the size of the annulus which it seals.

Accordingly, it is the object of the present invention to provide a water tight molded plastic dispensing closure, and it is a corollary object to provide a package that includes a container and a closure of the aforesaid character which is applied to such container. It is a further object of the present invention to provide a molded plastic dispensing closure which is water tight during the spray cooling of a package at an elevated temperature which includes such closure, in spite of the partial vacuum which will inherently develop within the closure during such spray cooling, and it is a further corollary object to provide a package that includes a container and a closure of the aforesaid character which is applied to such container.

For a further understanding of the present invention and the objects thereof, attention is directed to the drawing and the following brief description thereof, to the detailed description of the preferred embodiment and to the appended claims.

DETAILED DESCRIPTION OF THE PREFERRED EMBODIMENT

Figure 1:
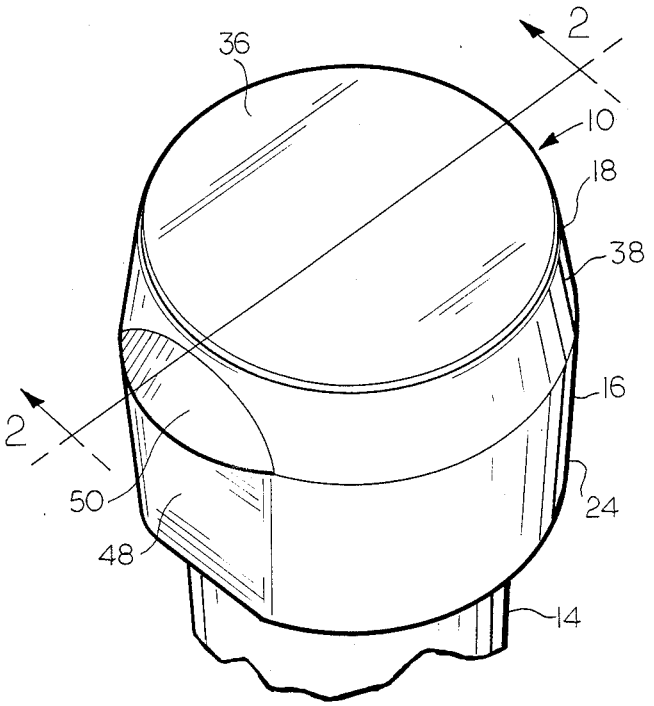
FIG. 1 is a perspective view of the preferred embodiment of a dispensing closure according to the present invention in the closed condition of such closure and in closing position on a container, shown fragmentarily.
Figure 3:
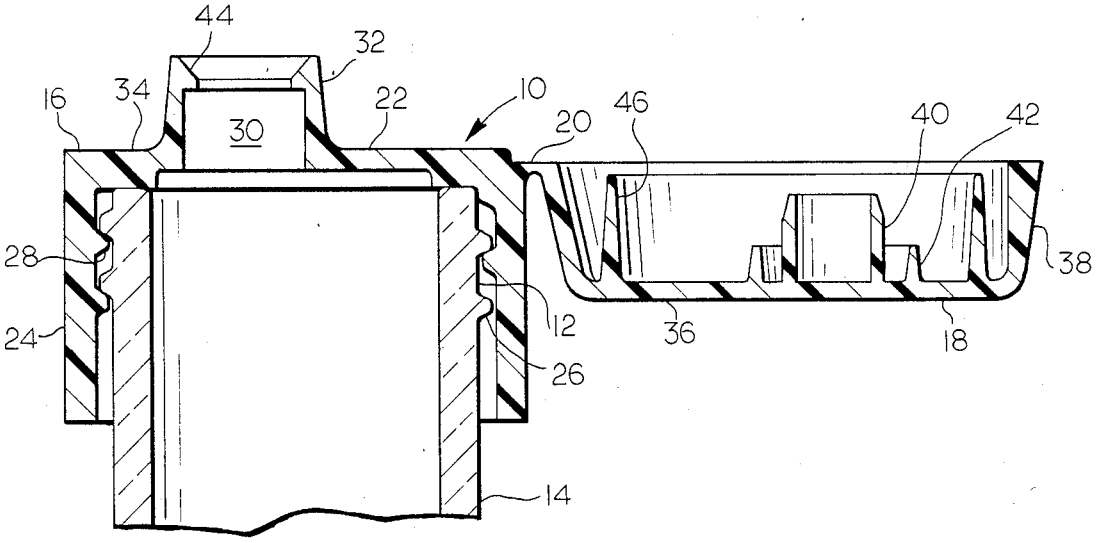
FIG. 3 is a view similar to FIG. 2 showing the closure of FIG. 2 in its open, dispensing condition.
Figure 2:
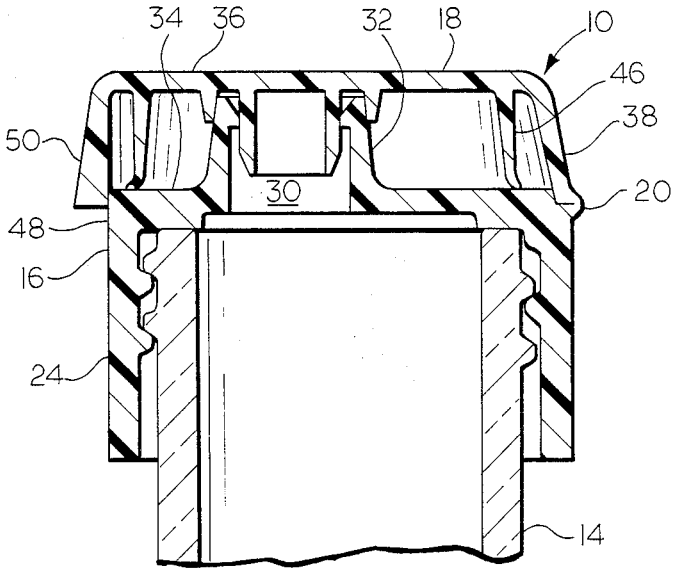
FIG. 2 is a sectional view taken on line 2—2 of FIG. 1.

As is shown in FIGS. 1–3, a package according to the present invention includes a closure according to the present invention, shown generally at 10, on the finish 12 of a container 14, shown fragmentarily, which, typically, may be a blown glass container or a blow molded plastic container. The closure 10 includes a first or body portion 16 which is directly affixed to the finish 12 of the container 14 and a second or cover portion 18 which is hingedly attached to the first portion 16 at a common edge 20 therebetween, and which is foldable with respect to the first portion 16 between a first or closed position, as is shown in FIG. 2, and a second or dispensing position, as is shown in FIG. 3. Alternatively, the attachment of the second portion 18 to the first portion can be by way of a strap hinge or a living hinge, both of which are known in the prior art.

The first portion 16 of the closure 10 includes a generally flat top panel 22 and an annular skirt 24 which extends downwardly from the top panel 22 to surround the upper portion of the finish 12 of the container 14. Attachment of the closure 10 to the finish 12 of the container 14 is accomplished by providing the finish 12 with an outwardly projecting and helically extending thread 26 and by providing the skirt 24 of the first portion 16 of the closure 10 with an inwardly projecting, complimental helically extending thread 28. Thus, the closure 10 may be applied to the container 14 by a screwing on action and it may be removed from the container by an unscrewing action. It is to be understood, however, that it is contemplated that other known types of closure to container attachment designs may be utilized, such as a bayonet attachment design or a lug style attachment design, or a snap on type of attachment design.

The first portion 16 of the closure 10 is provided with a dispensing opening 30 in the top panel 22 and the dispensing opening 30 is surrounded by a dispensing spout 32 which projects upwardly from the top panel 22 of the first portion 16 of the closure 10. The dispensing opening 30 permits the dispensing of the contents of the container 14, for example, chocolate syrup, mustard or catsup, through the first portion 16 of the closure 10, specifically, through the dispensing spout 32 thereof, without the need to remove the closure 10, or the first portion 16, from the finish 12 of the container 14. As shown in FIGS. 2 and 3 of the drawing, the size of the dispensing opening 30 is small in relationship to the size of the finish 12 of the container 14. Thus, there is formed an annulus 34 in the top panel 22 of the first portion 16 of the closure 10 between the skirt 24 and the dispensing spout 32 and the annulus is generally flat in view of the generally flat character of the top panel 22.

The second portion 18 of the closure 10 is provided with an imperforate top panel 36 and a skirt 38 which extends from the top panel 36 toward the top panel 22 of the first portion 16 when the second portion 18 is in closing position with respect to the first portion 16, as is shown in FIG. 2. The hinge at the common edge 20 of the first portion 16 and the second portion 18 of the closure 10 is located at the extremity of the skirt 38 of the second portion 18 which is away from the juncture of the skirt 38 and the top panel 36, and is near the juncture of the skirt 24 and the top panel 22 of the first portion 16 of the closure 10, as is shown, for example, in FIG. 3.

The top panel 36 of the second portion 18 of the closure 10 is provided with concentric inner and outer sealing fins 40 and 42, respectively, which extend therefrom toward the first portion 16 when the second portion 18 is in sealing position with respect to the first portion 16, as is shown in FIG. 2. The inner and outer sealing fins 40 and 42 of the second portion 18 of the closure 10 sealingly engage the inside and the outside, respectively, of the dispensing spout 32 of the first portion 16 to securely and sealingly close the container 14 when the second portion 18 of the closure 10 is in the FIG. 2 closing position. In that regard, it is noted that the upper portion of the dispensing spout 32 is provided with an inwardly projecting, tapered shoulder 44 at the uppermost extremely thereof, to help develop high unit loadings for good sealing between the dispensing spout 32 and the inner sealing fin 40, especially when the dispensing spout 32 is supported in an annular pattern surrounding the tapered shoulder 44 by the outer sealing fin 42, as shown.

To help prevent the ingress of moisture into the closure 10 when it is in its closed sealing position, as shown in FIG. 2, especially when the contents of the container 14 are forceably cooled from an elevated filling temperature by a spray cooling process, the second portion 18 of the closure 10 is provided with a secondary sealing fin 46 which extends downwardly from the top panel 36 at a location surrounding the outer sealing fin 42 and, preferably as shown, from a location on the top panel 36 which is closely adjacent to its juncture with the skirt 38, to sealingly engage against the top panel 22 of the first portion 16. Thus, the seal which is formed by the contact between the sealing fin 46 of the second portion 18 and the top panel 22 of the first portion 16 serves to prevent the ingress of moisture into the annulus 34, where it would otherwise accumulate on the top panel 22 of the first portion 16.

For ease of opening of the closure 10, the skirt 24 of the first portion 16 of the closure 10 is formed with a flattened external surface portion 48, at a location diametrically opposed to the location of the common edge 20 between the first portion 16, and the skirt 38 of the second portion 18 is provided with an enlarged radial portion 50 which is circumferentially aligned with the flattened surface portion 48 of the first portion 16 to facilitate the opening of the closure 10 by thumb pressure against the first portion 16, as is known in the prior art.

Closures such as the closure 10 may be rapidly and relatively inexpensively mass produced from a suitable thermoplastic material by injection molding. Suitable thermoplastic materials include high density polyethylene and polypropylene, normally in an admixture that includes minor quantities of various additives such as plasticizers and colorants.

Figure 4:
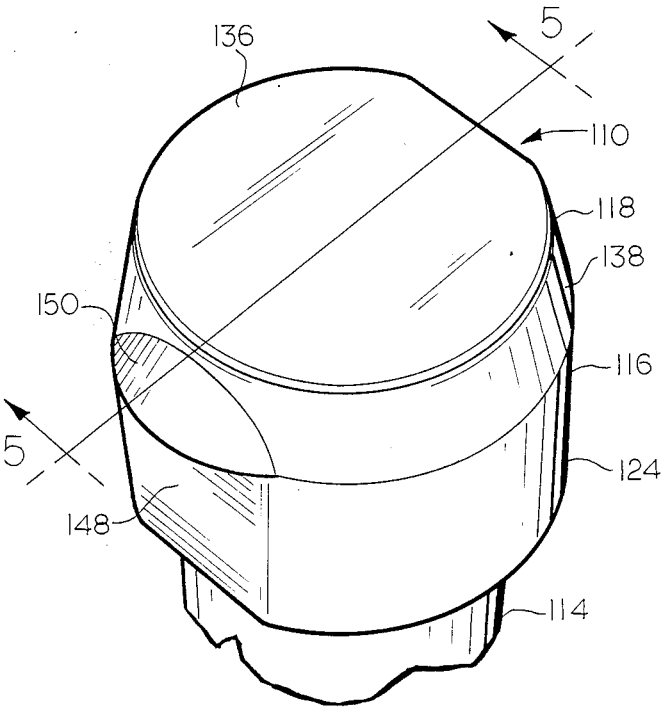
FIG. 4 is a view similar to FIG. 1 showing an alternative embodiment of a closure according to the present invention.
Figure 6:
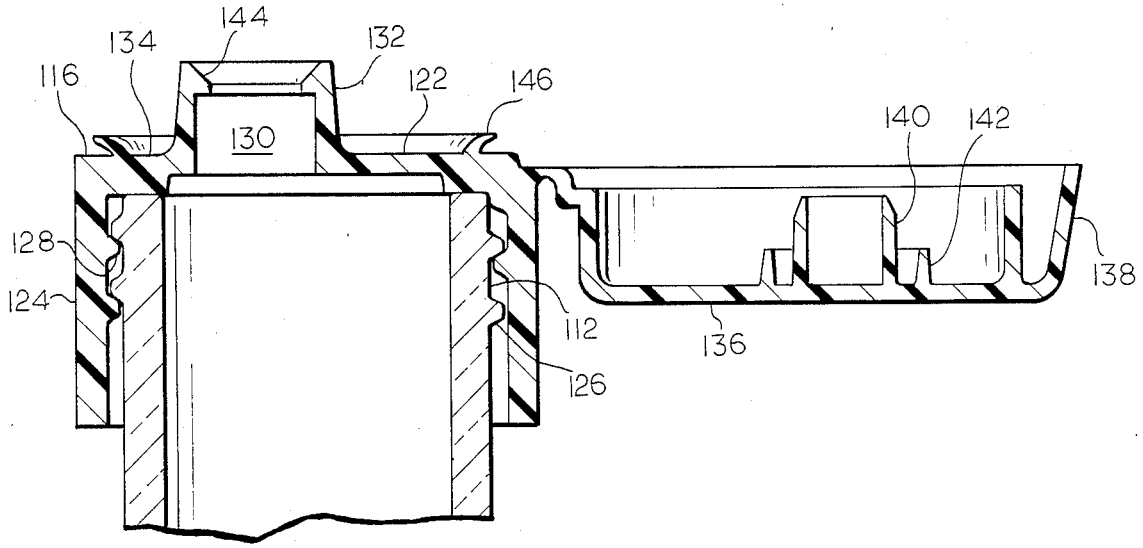
FIG. 6 is a view similar to FIG. 5 showing the closure of FIG. 5 in its open, dispensing condition.
Figure 5:
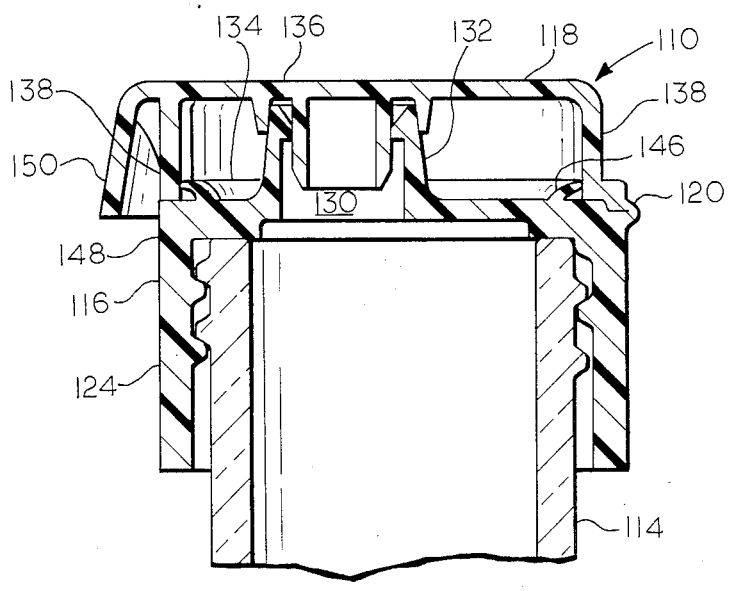
FIG. 5 is a sectional view taken on line 5—5 of FIG. 4.

In the embodiment of FIG. 4 through 6 elements which correspond to or are analogous to the elements of the embodiment of FIGS. 1 through 3 are identified by a 100 series numeral, the last two digits of which correspond to the two digits of the corresponding or analogous element of the embodiment of FIGS. 1 through 3.

As is shown in FIG. 4–6, a package according to this embodiment of the present invention includes a closure according to the present invention, shown generally at 110, on the finish 112 of a container 114, shown fragmentarily, which, typically, may be a blow glass container or a blown molded plastic container. The closure 110 includes a first or body portion 116 which is directly affixed to the finish 112 of the container 114 and a second or cover portion 118 which is hingedly attached to the first portion 116 at a common edge 120 therebetween, and which is foldable with respect to the first portion 116 between a first or closed position, as is shown in FIG. 5, and a second or dispensing position, as is shown in FIG. 6.

The first portion 116 of the closure 110 includes a generally flat top panel 122 and an annular skirt 124 which extends downwardly from the top panel 122 to surround the upper portion of the finish 112 of the container 114. Attachment of the closure 110 to the finish 112 of the container 114 is accomplished by providing the finish 112 with an outwardly projecting and helically extending thread 126 and by providing the skirt 124 of the first portion 116 of the closure 110 with an inwardly projecting, complimental helically extending thread 128. Thus, the closure 110 may be applied to the container 114 by a screwing on action and it may be removed from the container by an unscrewing action.

The first portion 116 of the closure 110 is provided with a dispensing opening 130 in the top panel 122 and the dispensing opening 130 is surrounded by a dispensing spout 132 which projects upwardly from the top panel 122 of the first portion 116 of the closure 110. The dispensing opening 130 permits the dispensing of the contents of the container 114, for example, chocolate syrup, mustard or catsup, through the first portion 116 of the closure 110, specifically, through the dispensing spout 132 thereof, without the need to remove the closure 110, or the first portion 116, from the finish 112 of the container 114. As noted in FIGS. 5 and 6 of the drawing, the size of the dispensing opening 130 is small in relationship to the size of the finish 112 of the container 114. Thus, there is formed an annulus 134 in the top panel 122 of the first portion 116 of the closure 110 between the skirt 124 and the dispensing spout 132 and the annulus is generally flat in view of the generally flat character of the top panel 22.

The second portion 118 of the closure 110 is provided with an imperforate top panel 136 and a skirt 138 which extends from the top panel 136 toward the top panel 122 of the first portion 116 when the second portion 118 is in closing position with respect to the first portion 116, as is shown in FIG. 5. The hinge at the common edge 120 of the first portion 116 and the second portion 118 of the closure 110 is located at the extremity of the skirt 138 of the second portion 118 which is away from the juncture of the skirt 138 and the top panel 136, and is near the juncture of the skirt 124 and the top panel 122 of the first portion 116 of the closure 110, as is shown, for example, in FIG. 6.

The top panel 136 of the second portion 118 of the closure 110 is provided with concentric inner and outer sealing fins 140 and 142, respectively, which extend therefrom toward the first portion 116 when the second portion 118 is in sealing position with respect to the first portion 116, as is shown in FIG. 5. The inner and outer sealing fins 140 and 142 of the second portion 118 of the closure 110 sealingly engage the inside and the outside, respectively, of the dispensing spout 132 of the first portion 116 to securely and sealingly close the container 114 when the second portion 118 of the closure 110 is in the FIG. 5 closing position. In that regard, it is noted that the upper portion of the dispensing spout 132 is provided with an inwardly projecting, tapered shoulder 144 at the uppermost extremely thereof, to help develop high unit loadings for good sealing between the dispensing spout 132 and the inner sealing fin 140, especially when the dispensing spout 132 is supported in an annular pattern surrounding the tapered shoulder 144 by the outer sealing fin 142, as shown.

To help prevent the ingress of moisture into the closure 110 when it is in its closed sealing position, as shown in FIG. 5, especially when the contents of the container 115 are forceably cooled from an elevated filling temperature by a spray cooling process, the first portion 116 of the closure 110 is provided with an annular secondary sealing fin 146 which extends upwardly and outwardly from the top panel 122 at a location surrounding the dispensing spout 132 and, preferably as shown, from a location on the top panel 122 which is closely adjacent to its juncture with the skirt 124, to sealingly engage the skirt 138 of the second portion 118. Thus, the seal which is formed by the contact between the sealing fin 146 of the first portion 116 and the skirt 138 of the second portion 118 serves to prevent the ingress of moisture into the annulus 134, where it would otherwise accumulate on the top panel 122 of the first portion 116.

For ease of opening of the closure 110, the skirt 124 of the first portion 116 of the closure 110 is formed with a flattened external surface portion 148, at a location diametrically opposed to the location of the common edge 120 between the first portion 116, and the skirt 138 of the second portion 118 is provided with an enlarged radial portion 150 which is circumferentially aligned with the flattened surface portion 148 of the first portion 116 to facilitate the opening of the closure 110 by thumb pressure against the first portion 116, as is known in the prior art.

It is also noted that, to properly position the second portion 118 with respect to the first portion 116, the skirt 138 of the second portion 118 should have an axial length such that it abuts the top panel 122 of the first portion 116 when the second portion 118 is in its FIG. 5 closed position.

Closures such as the closure 110 may be rapidly and relatively inexpensively mass produced from a suitable thermoplastic material by injection molding. Suitable thermoplastic materials include high density polyethylene and polypropylene, normally in an admixture that includes minor quantities of various additives such as plasticizers and colorants.

This invention, and the manner and process of making its and using it, has been described above in terms sufficiently full, clear, concise, and exact as to enable any person skilled in the art to make and use the same, and the best mode contemplated by the inventor for carrying out the invention has been set forth. It is to be understood, however, that it is contemplated that certain modifications of the above described invention, and/or best mode of carrying out the invention can be made by a skilled artisan without departing from the scope of the invention, and it is, therefore, desired to limit the invention only in accordance with the appended claims.

What is claimed is:

1. A one-piece dispensing closure for a container that contains a flowable product, the container having an annular closure receiving finish, said closure being molded from a thermoplastic material and comprising:

a body portion having a generally flat top panel that is adapted to span the finish of the container and an annular skirt depending from said top panel, said annular skirt having container finish engaging means and being adapted to surround and engage the finish portion of the container, said top panel having dispensing opening means therein to permit the dispensing of the flowable product from the container through said body portion, said dispensing opening means comprising an opening in said top panel and an annular spout surrounding said dispensing opening, said annular spout having a longitudinal central axis, an inside surface, and an outside surface;

a cover portion hingedly attached to said body portion, said cover portion having a top panel, an annular skirt and first sealing means, said cover portion being foldable from a first position where said first sealing means sealingly engages said dispensing opening means to prevent the dispensing of the flowable product from the container and a second position where said first sealing means does not engage said dispensing opening means, said annular skirt projecting from said top panel of said cover portion toward said top panel of said body portion when said cover portion is in said first position, said annular spout projecting from said top panel of said body portion toward said top panel of said cover portion when said cover portion is in said first position, said first sealing means comprising means for engaging one of said inside surface and said outside surface of said annular spout in an annular pattern when said cover is in said first position; and second sealing means carried by one of said body portion and said cover portion, said second sealing means surrounding said dispensing opening means and defining an annular space therewith, said second sealing means comprising an elongate flexible member and sealingly engaging the other of said body portion and said cover portion when said cover portion is in said first position to prevent contaminants from outside the container from entering said annular spade, said second sealing means extending in a direction which is not perpendicular to said longitudinal central axis of said annular spout.

2. A one-piece dispensing closure according to claim 1 wherein said second sealing means comprises an annular fin attached to said top panel of said cover portion and projecting inwardly therefrom, said annular fin further projecting toward said top panel of said body portion said cover portion is in said first position, said annular fin sealingly engaging said top panel of said body portion when said cover portion is in said first position.

3. A one-piece dispensing closure according to claim 4 wherein said opening in said top panel of said body portion is small in relationship to the size of said annular skirt of said body portion.

4. A one piece dispensing closure according to claim 1 wherein said second sealing means comprises an annular fin attached to said top panel of said body portion, said annular fin projecting non-perpendicularly from said top panel of said body portion toward said cover portion when said cover portion is in said first position, said annular fin sealingly engaging said cover portion when said cover portion is in said first position.

5. A one-piece dispensing closure according to claim 1 wherein said first sealing means further comprises means for engaging the other of said inside surface and said outside surface of said annular spout when said cover portion is in said first position.

6. A one-piece dispensing closure according to claim 1 wherein said thermoplastic material has, as its major ingredient, a material selected from the group consisting of high density polyethylene and polypropylene.

7. A one-piece dispensing closure according to claim 6 wherein said closure is molded by injection molding.

8. A one-piece dispensing closure according to claim 1 wherein the closure receiving finish of the container has externally projecting and helically extending thread means, and wherein said container finish engaging means of said annular skirt of said body portion comprises inwardly projecting and helically extending thread means.

9. A package comprising, in combination:

a container for containing a flowable product, said container having an annular closure receiving finish and closure engaging means projecting radially outwardly from said closure receiving finish; and a one-piece dispensing closure engaging said annular closure receiving finish of said container, said closure being molded from a thermoplastic material and comprising;

a body portion, said body portion having a generally flat top panel spanning said finish of said container, an annular skirt depending from said top panel and surrounding said closure receiving finish of said container, and container finish engaging means projecting radially inwardly from said annular skirt and engaging said closure engaging means of said container, said top panel having dispensing opening means of said container, said top panel having dispensing opening means therein for the dispensing of the flowable product from said container through said body portion, said dispensing opening means comprising an opening in said top panel and an annular spout surrounding said dispensing opening, said spout having a longitudinal central axis, an inside surface, and an outside surface; and a cover portion hingedly attached to said body portion, said cover portion having a top panel, an annular skirt and first sealing means said cover portion being foldable from a first position where said first sealing means sealingly engages said dispensing opening means to prevent the dispensing of the flowable product from said container to a second position where said first sealing means does not engage said dispensing opening means, said annular skirt projecting from said top panel of said cover portion toward said top panel of said body portion of said closure when said cover portion is in said first position, and wherein said annular spout projects from said top panel of said body portion toward said top panel of said cover portion when said cover portion is in said first portion, said first sealing means comprising means for engaging one of said inside surface and said outside surface of said annular spout in an annular pattern when said cover portion of said closure is in said first portion; and second sealing means carried by one of said body portion and said cover portion, said second sealing means surrounding said dispensing opening means and defining an annular space therewith, said second sealing means comprising an elongate flexible member and sealingly engaging the other of said body portion and said cover portion when said cover portion is in said first position to prevent contaminants from outside said container from entering said annular space, said second sealing means extending in a direction which is not perpendicular to said longitudinal central axis of said annular spout.

10. A package according to claim 9 wherein said second sealing means of said closure comprises an annular fin attached to said top panel of said cover portion of said closure and projecting inwardly therefrom, said annular fin further projecting toward said top panel of said body portion when said cover portion is in said first position, said annular fin sealingly engaging said top panel of said body portion when said cover portion is in said first position.

11. A package according to claim 10 wherein said opening in said top panel of said body portion of said closure is small in relationship to the size of said annular skirt of said body portion.

12. A package according to claim 9 wherein said second sealing means of said closure comprises an annular fin attached to said top panel of said body portion of said closure, said annular fin projecting non-perpendicularly from said top panel of said body portion toward said cover portion when said cover portion of said closure is in said first position, said annular fin sealingly engaging said cover portion when said cover portion is in said first position.

13. A package according to claim 9 wherein said first sealing of said closure means further comprises means for engaging the other of said inside surface and said outside surface of said annular spout of said closure when said cover portion of said closure is in said first position.

14. A package according to claim 9 wherein said thermoplastic material has, as its major ingredient, a material selected from the group consisting of high density polyethylene and polypropylene.

15. A package according to claim 14 wherein said closure is molded by injection molding.

16. A package according to claim 9 wherein said closure engaging means of said closure receiving finish of said container comprises externally projecting and helically extending thread means, and wherein said container finish engaging means of said annular skirt of said body portion of said closure comprises inwardly projecting and helically extending thread means.

* * * * *